US006125605A

United States Patent [19]

Young

[11] Patent Number: 6,125,605

[45] Date of Patent: Oct. 3, 2000

[54] CLADDING FOR TRIM MEMBERS USED ON BUILDINGS

[76] Inventor: Robert H. Young, 2902 Bethel Church Rd., Beaver Dam, Ky. 42320

[21] Appl. No.: 09/054,562

[22] Filed: Apr. 3, 1998

[51] Int. Cl.[7] ..... E04F 19/02

[52] U.S. Cl. ..... 52/717.01; 52/717.05; 52/716.1; 52/211; 52/288.1

[58] Field of Search ..... 52/717.01, 718.05, 52/718.02, 717.03, 717.05, 718.01, 716.1, 211, 204.1, 287.1, 288.1, 716.2, 204.2, 204.53; 49/504, 505, DIG. 2

[56] References Cited

U.S. PATENT DOCUMENTS

| | | | |
|---|---|---|---|
| 1,769,424 | 7/1930 | Ellison . | |
| 2,149,742 | 3/1939 | Miller | 52/717.03 |
| 2,582,468 | 1/1952 | Sylvan | 52/211 |
| 2,837,183 | 6/1958 | Heiman . | |
| 2,910,033 | 10/1959 | Weisburg | 52/718.02 X |
| 2,969,618 | 1/1961 | Ratner . | |
| 3,393,484 | 7/1968 | Dunnington | 52/717.05 X |
| 3,443,345 | 5/1969 | Spencer | 52/204.53 |
| 3,478,478 | 11/1969 | Luebs . | |
| 3,609,928 | 10/1971 | Mock | 52/718.05 X |
| 3,831,334 | 8/1974 | Ruthowski et al. | 52/717.05 X |
| 3,902,292 | 9/1975 | LaBorde . | |
| 3,974,606 | 8/1976 | LaBorde | 52/288.1 |
| 4,204,376 | 5/1980 | Calvert | 52/309.1 |
| 4,214,414 | 7/1980 | Wendt | 52/288.1 |
| 4,663,906 | 5/1987 | Weinar | 52/718.02 X |
| 4,928,430 | 5/1990 | George . | |
| 4,947,606 | 8/1990 | LaSee . | |
| 4,947,614 | 8/1990 | Mayle | 52/717.03 X |
| 5,058,323 | 10/1991 | Gerritsen | 52/211 X |
| 5,182,880 | 2/1993 | Berge, Jr. et al. . | |
| 5,222,343 | 6/1993 | Anderson | 52/717.05 X |
| 5,305,566 | 4/1994 | Larkowski | 52/211 |
| 5,551,201 | 9/1996 | Anderson . | |
| 5,669,192 | 9/1997 | Opdyke et al. | 52/211 |
| 5,758,458 | 6/1998 | Ridge | 52/211 X |

FOREIGN PATENT DOCUMENTS

| | | | |
|---|---|---|---|
| 1379743 | 10/1964 | France | 52/288.1 |
| 31978 | 5/1956 | Germany | 52/716.1 |
| 79475 | 12/1951 | Norway | 52/718.02 |
| 1512288 | 6/1978 | United Kingdom | 52/288.1 |

*Primary Examiner*—Laura A. Callo
*Attorney, Agent, or Firm*—Maurice L. Miller, Jr.

[57] ABSTRACT

An improved cladding for covering the exterior facing surfaces of an exterior trim member of a building structure is disclosed which includes means for concealing holes in an exterior surface portion of the cladding formed by or for fasteners driven through the surface portion into the trim member to join the trim member to an adjacent structural member. The concealing means includes a tiltable flap hingably attached along one edge portion thereof to an exterior corner of the cladding. The flap is tiltable between an open position wherein fasteners can be driven through a flap underlying surface portion of the cladding and a closed, operative position wherein the flap is held flush against the underlying surface portion of the cladding to conceal the fastener holes therein from view. Different arrangements for securing the flap in the closed, operative position are also disclosed.

14 Claims, 2 Drawing Sheets

FIG. 1
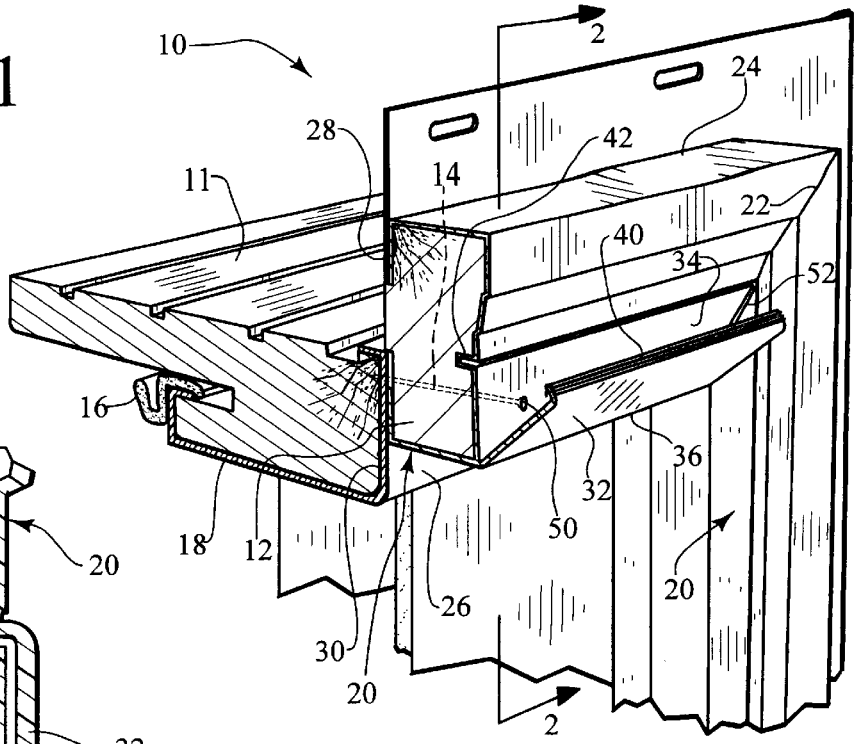
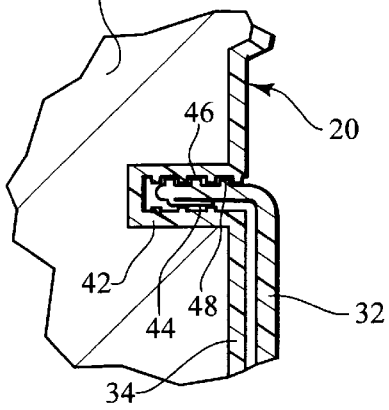
FIG. 2a
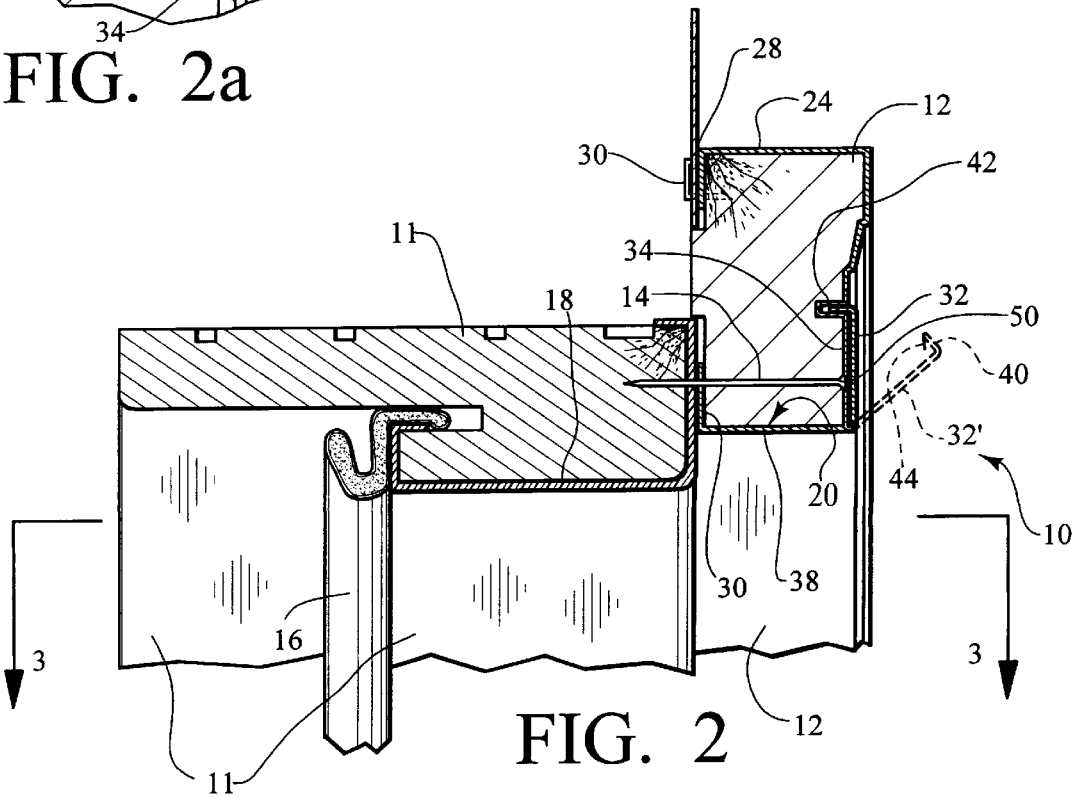
FIG. 2

CLADDING FOR TRIM MEMBERS USED ON BUILDINGS

BACKGROUND OF THE INVENTION

This invention relates generally to an improved cladding for covering exterior facing surfaces of wood, foam, plastic, particle board, vinyl and urethane trim members of buildings such as window and exterior door frame trim and moldings for exterior siding. More specifically, this invention relates to such cladding which features a flap hingably connected to a surface portion thereof which has an open position tilted away from the surface portion to permit fasteners to be driven through the surface portion and a closed position flush against the surface portion for concealing holes through the surface portion through which fasteners have been driven to fasten the cladding covered trim member to an adjacent structural member.

Broadly speaking, semi-flexible plastic cladding for covering the otherwise exposed exterior surfaces of trim members, such as, for example, wooden trim members, which are fastened to adjacent wooden structural elements are known in the prior art. In some cases such prior art cladding can be applied to trim members after fasteners have been driven through the trim member to secure it to an adjacent wooden supporting member. See, for example, U.S. Pat. No. 3,478,478 issued in the name of D. F. Luebs on Nov. 18, 1969 for a snap-on plastic cover. Obviously, in cases such as this, no unsightly holes need be made in the cladding and the snap-on cladding will conceal the fastener heads in the surface of the trim member from view. See also the liners used to cover nails driven through siding into supporting wooden structural members in U.S. Pat. Nos. 3,902,292 and 3,974,606 issued to J. N. LaBorde on Sep. 2, 1975 and Aug. 17, 1976, respectively. In the two latter mentioned patents, however, the liners stand off of the members being covered to conceal nails, but do not fit those members in a close conforming manner.

By means of my invention, the cladding can be advantageously applied to a trim element in a close fitting manner before the trim element is fastened to a supporting structural element and, yet, the fasteners and holes made through the cladding by or for the fasteners can still be concealed from view.

SUMMARY OF THE INVENTION

It is an object of my invention to provide an improved cladding for covering a trim element which is adapted to be joined by fasteners driven through the cladding and trim element to an adjacent structural member of a building, the improvement being in means for concealing the fastener holes in the cladding from view.

Briefly, in accordance with my invention, there is provided an improved cladding of the type which is conventionally adapted to cover externally facing surfaces of an external trim element of a building structure and through which fasteners can be driven in order to join the trim element to an adjacent element of the structure. The improvement comprises a tiltable flap hingably attached to and along the cladding. The flap has an open position tilted away from an externally facing surface portion of the cladding to permit fasteners to be driven through the surface portion to join the trim element to the adjacent structural element. The flap also has a closed, operative position which is parallel to the surface portion to conceal holes in the surface portion from view through which the fasteners are driven.

These and other objects, features and advantages of my invention will become apparent to those skilled in the art from the following detailed description and attached drawings upon which, by way of example, only the preferred embodiments of my invention are described and illustrated.

BRIEF DESCRIPTION OF THE DRAWINGS

FIG. 1 shows a perspective view of a corner portion of an exterior wooden doorjamb and attached wooden brick molding trim element, exterior facing surfaces of the jamb and molding being covered by plastic cladding, the cladding of the brick molding having provision for concealing fasteners used to attach the wood members together, thus illustrating a preferred embodiment of my invention.

FIG. 2 shows a cross-sectional elevation view of the jamb and molding of FIG. 1 as viewed along cross-section lines 2—2 of the latter mentioned figure.

FIG. 2*a* shows an enlarged detail view of a fragment of the molding cover and trim element of FIGS. 1–2, the same as viewed in the latter mentioned figure.

DESCRIPTION OF THE PREFERRED EMBODIMENT

Figure 3:
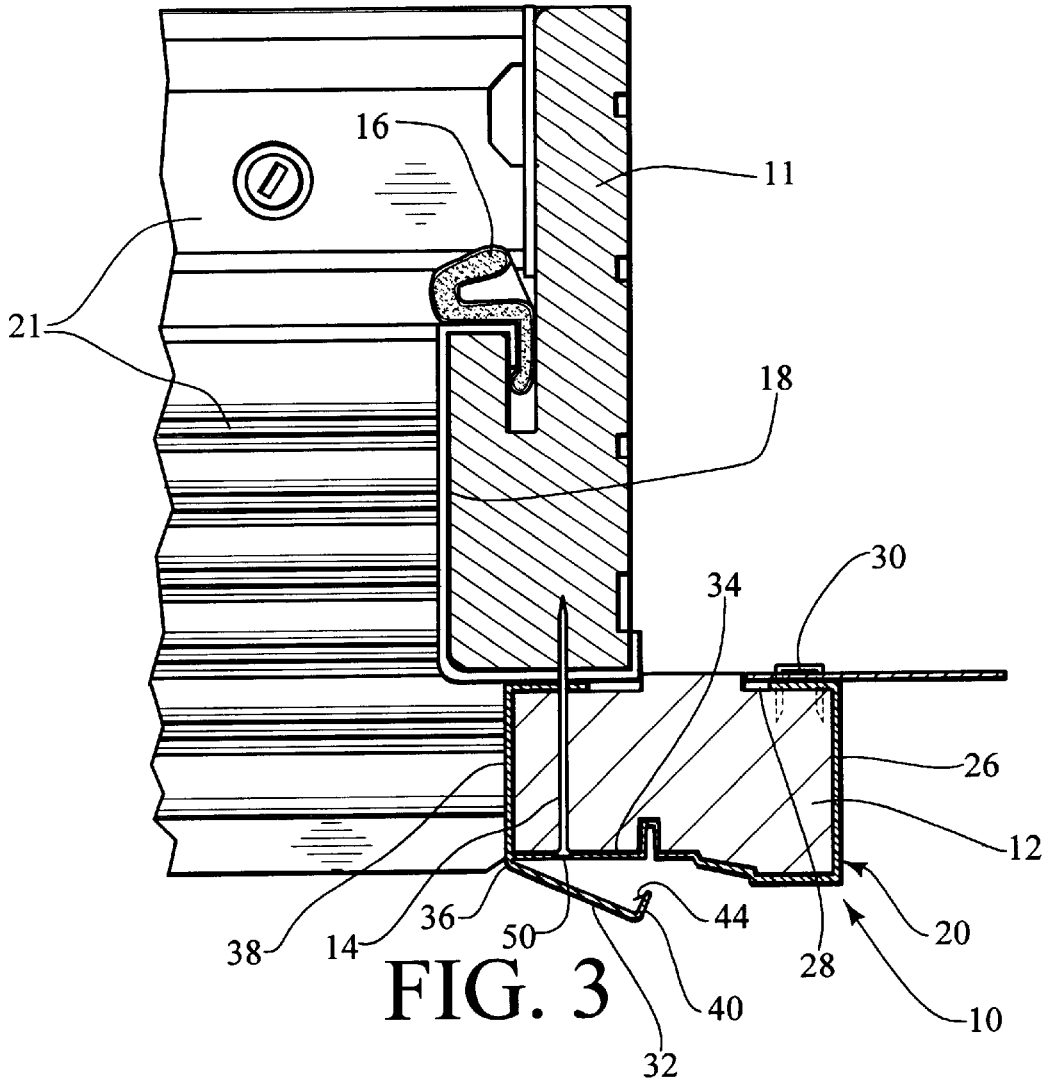
FIG. 3 shows a cross-sectional plan view of the jamb and molding of FIGS. 1–2 as viewed along cross-section lines 3—3 of FIG. 2, with portions of a door sill assembly at the base of the jamb and molding being added.

Referring now to the drawing figures and, in particular, to FIGS. 1, 2, 2*a* and 3 there is shown, in a preferred embodiment of my invention, an exterior doorway assembly, generally designated 10, for a residence or other building structure. The assembly 10 includes a conventional wooden door jamb 11 and a conventional wooden trim element, specifically, a molding or casing 12 for siding such as, for example, brick, stone, wood or vinyl, the casing being attached to the jamb by suitable spaced apart fasteners such as nails 14. The jamb 11 contains a conventional weather strip 16 against which an exterior door, not shown, can be closed, and a conventional semi-flexible, preferably plastic cladding or cover 18 which snap fits in close conforming relation over exterior facing surfaces of the jamb. The molding 12 also contains an improved semi-flexible, preferably plastic cladding or cover, generally designated 20, with which this invention deals, which cladding is preferably constructed of the same commonly used material as that of the jamb cover 18. The cladding 20 covers the exterior facing surfaces of the molding 12 in, preferably, a close conforming manner.

Conventionally, the jamb 11 contains three members, one of which defines the upper surface of the doorway opening as shown in cross-section at 11 in FIG. 2 and two vertically extending side members defining opposite sides of the doorway opening, only one of which side members is shown in the drawings, it being the same against which the door closes as shown in cross-section at 11 in FIG. 3. The upper member of the jamb 11 normally rests upon the upper ends of the two opposing side members. At the lower end of the jamb 11 and molding 12 there is shown a conventional door sill assembly 21 extending across the base of the doorway opening. See FIG. 3.

Also, conventionally, the molding 12 can be constructed of three members, one of which is an upper member which is attached to and along a front facing vertical surface of the upper member of the jamb 11 as shown in cross-section at 12 in FIG. 1. The remaining two members of the molding 12 are two side members which are attached to and along front facing, vertically extending surfaces of the opposing side members of the jamb 11, one of which molding side members is shown in cross-section as at 12 in FIG. 3. Each of the side members of the molding 12 are conventionally adjoined with opposite ends of the upper molding member to form two miter joints, only one of which is shown as at 22 in FIG. 1.

The molding cover 20 is preferably also formed in three segments, one of which covers the externally facing surfaces of the upper member of the molding 12 as shown in cross-section in FIG. 1. The other two segments cover the externally facing surfaces of the opposing side members of the molding 12, one of which side member cover segments is shown in cross-section at 20 in FIG. 3. The side member segments of the cover 20 have upper ends which are mitered in conformity with corresponding ends of the upper member segment to form a mitered abutment 52 aligned with the miter joint 22 in the molding 12, one of which is shown in FIG. 1 at 22. An upper surface 24 of the cover 20 (See FIGS. 1–2) and lateral side surfaces 26 thereof, only one of which is shown as at 26 in FIG. 3, overlap the back surfaces of the members of the molding 12, as at 28. The overlaps 28 can be suitably fastened to and along the back surfaces of the molding 12 such as by means of a series of spaced apart staples 30.

The improvement in the otherwise conventional molding cover 20 is a provision for concealing unsightly and otherwise weather degradable fastener holes formed through a front surface portion 34 of the cover 20 by the nails 14 which are necessary to adjoin the molding 12 to the jamb 11 as previously explained. To accomplish this result, a tiltable flap 32 is provided which is hingably attached, preferably, to and along external, door opening defining edge portions of the three segments of the cover 20, which flap can be opened away from the molding 12, as shown in full in FIGS. 1 and 3 and in phantom at 32' in FIG. 2, to permit nails 14 to be driven through a flap underlying surface portion 34 of the cover. The flap 32 preferably employs a conventional live hinge 36 (See FIGS. 1 and 3) at its joinder with a doorway facing surface 38 of the cover 20. The flap 32 preferably includes a free end which contains an essentially perpendicularly extending end portion 40 adapted to friction fit tightly into and along a groove 42 formed in and along a front facing surface portion of the molding 12, into which a blind slot in a front surface of the cover 20 projects. The groove or blind slot in the cover 20 closely conforms to and fits tightly within the groove in the molding 12. The end portion 40 of the present example contains a springable, projecting member 44 which projects outwardly at an oblique angle, away from the end portion when relaxed and when the end portion is removed from the groove 42 as seen at 44 in FIG. 2. Upon insertion of the end portion 40 into the groove 42, the member 44 is forcibly tilted against the end portion to help secure the end portion tightly within the groove 42 as shown best in FIG. 2*a*. The end portion 40 may also contain a series of raised, spaced apart ribs 46 which fit within conforming, spaced apart slots 48 in the groove 42 when snap fit into the latter. In this manner, the open flap 32 can be pushed by hand and pressed flat against the underlying surface portion 34, whereby the end portion 40 holds the flap in a closed position against the surface portion 34 to conceal the unsightly fastener holes in the underlying surface portion from view, as shown at 50. The groove 42 is thus located on and along a border of the surface portion 50. The flap 32 and end portion 40 also act as a weather seal to keep moisture from continually seeping into and around the holes 50 which would otherwise occur in the absence thereof. Opposing ends of the flaps 32 in adjacent segments of the cover 20 also form mitered abutments when closed in their operative positions to thus overlie portions of the mitered joints 22 in the molding. See miter 52 in FIG. 1.

Figure 4:
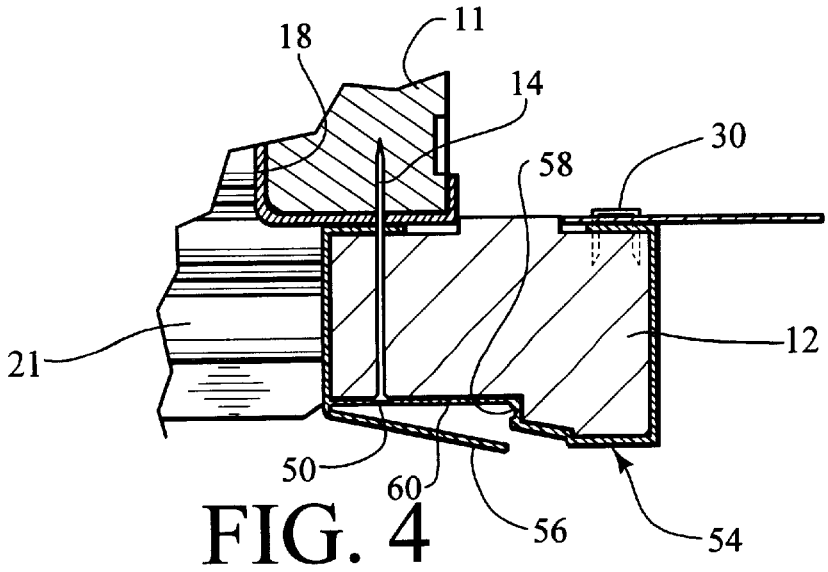
FIG. 4 shows a cross-sectional plan view of a portion of a door jamb, door sill and attached brick molding, the same as viewed in FIG. 3, thus illustrating another important embodiment of my invention.

Referring now to FIG. 4 another important embodiment of my invention is shown. The door jamb 11, door jamb cover 18, door sill 21 and molding 12 shown in this figure are the same as in the previous example of FIGS. 1, 2, 2*a* and 3. A cover or cladding 54 for the molding 12 is also identical with the cover 20 of the previous example except for the manner in which a fastener concealing flap 56 snap fits into the cover at its free end upon closure to conceal the hole through which of the nail 14 is driven. In this example, a wall or edge of the cover 54 into which the free end of the flap 56 locks when closed contains an elongated indention or groove 58. The free end of the flap 56 thus snaps into groove 58 to hold the flap flush against an underlying surface portion 60 of the cover 54 to thus conceal the holes 50 in the underlying cover portion through which the nails 14 were driven prior to closure thereof.

The cladding or cover of my invention may thus be used to conceal the holes made in a surface portion thereof by or for any of the usual types of fasteners, including not only nails, as shown in the foregoing examples, but also by threaded fasteners of all kinds, pins and the like, of a type suitable for fastening an exterior trim element to an adjacent element in a building structure. The flap containing cover of my invention can be adapted for use with a wide variety of trim elements to conceal fastener holes other than brick molding as, for example, moldings for other types of siding such as stone, block, wood, and the like. Such a cover can also be adapted for use with window frames or casings, trim elements therefor and, as here, with door frame trim elements of the type which are to be adjoined by fasteners to other adjacent structural elements.

The cladding of my invention can not only be used with wooden trim members but also with such members constructed of foam, plastic, particle board, vinyl and urethane. In such cases a foam trim member could be extruded and then, when sufficiently cooled or cured, a plastic jacket could be co-extruded thereon to form the cladding containing the flap.

While the present invention has been explained with respect to specific details of certain preferred embodiments thereof, it is not intended that such details limit the scope and coverage of this patent other than as specifically set forth in the following claims.

I claim:

1. An improved cladding of the type which is conventionally adapted to cover externally facing surfaces of an external trim element of a building structure and through which fasteners can be driven in order to join the trim element to an adjacent element of the structure, the improvement of which comprises a tiltable flap permanently hingably attached to and along said cladding, said flap having an open position tilted away from an externally facing surface portion of said cladding to permit fasteners to be driven through said surface portion in order to join the trim element to the adjacent element, said flap having a closed, operative position which covers at least a section of said surface portion to conceal holes in said section through which the fasteners have been driven, said flap being hingably attached to and along an external edge of said cladding, a free edge of said flap being closable along and against a border of said surface portion which extends alone a central part of an externally facing surface of said cladding, which border is spaced from said external edge, said cladding including a wall projecting perpendicular therefrom which extends along said border, said wall containing a depression into which said free edge of said flap snap fits upon placing said flap in said closed, operative position.

2. The improved cladding of claim 1 wherein said cladding and flap are constructed of a semi-flexible plastic material.

3. The improved cladding of claim 1 wherein a hinge by which said flap is hingably attached to said cladding comprises a live hinge.

4. The improved cladding of claim 1 further comprising means for attaching said flap to said cladding upon placing said flap in said closed, operative position.

5. The improved cladding of claim 1 further comprising means for attaching said free edge portion of said flap to said cladding upon placing said flap in said closed, operative position.

6. The improved cladding of claim 1 further comprising an end portion attached to the free edge of said flap and projecting essentially perpendicular therefrom, said border being defined by a blind slot in said cladding into which said end portion projects upon placing said flap in said closed, operative position.

7. The improved cladding of claim 6 wherein the end portion of said flap includes a springable member attached on one end thereof to said end portion which projects away from said end portion when relaxed and when said flap is in said open position, said springable member being forcibly tilted against said end portion when said end portion is inserted into said blind slot upon placing said flap in said closed, operative position.

8. The improved cladding of claim 6 wherein said border defining blind slot defines at least one groove which opens onto an interior defining wall thereof, said end portion also containing at least one raised rib adapted to insert into and tightly conform to said interior defining wall groove when said end portion is inserted into said blind slot upon placing said flap in said closed, operative position.

9. A trim assembly for a building structure comprising a structural member for a building;

a trim element fastened by at least one fastener to said structural member; and a cladding covering otherwise exposed surfaces of said trim element, said cladding including a tiltable flap permanently attached to and along said cladding, said flap having an open position tilted away from an externally facing surface portion of said cladding, said at least one fastener being driven through said surface portion and said trim element into said structural member when said flap is disposed in said open position, said flap also having a closed position which is parallel with and which covers at least a section of said surface portion to conceal holes from view made by or for said at least one fastener in said section of the surface portion of said cladding.

10. The combination of claim 9 wherein said trim element comprises a material selected from the group consisting of wood, foam, plastic, particle board, vinyl and urethane.

11. The combination of claim 9 wherein the trim element comprises a molding for siding.

12. The combination of claim 11 wherein said molding is constructed of wood.

13. The trim assembly of claim 9 wherein said structural element comprises a door jamb.

14. A trim assembly for a building structure comprising a structural member for a building;

a trim element fastened by at least one fastener to said structural member; and a cladding covering otherwise exposed surfaces of said trim element, said cladding including a flap forming at least one surface of said cladding which is permanently hingably attached to a remaining portion of said cladding, said flap having an open position which is titled away from one of said exposed surfaces, said at least one fastener being driven into said one of said exposed surfaces to extend through said trim element into said structural member when said flap is disposed in said open position, said flap also having a closed position covering at least a portion of one of said exposed surfaces to conceal the position occupied by said at least one fastener.

* * * * *